US006032848A

United States Patent [19]

Smolinski

[11] Patent Number: 6,032,848

[45] Date of Patent: Mar. 7, 2000

[54] FASTENER-DRIVING TOOL HAVING WEAR GUARD DEFINING FASTENER-GUIDING SURFACE

[75] Inventor: Dariusz Smolinski, Chicago, Ill.

[73] Assignee: Illinois Tool Works Inc., Glenview, Ill.

[21] Appl. No.: 09/187,829

[22] Filed: Nov. 6, 1998

[51] Int. Cl.[7] ..... B25C 1/04

[52] U.S. Cl. ..... 227/136; 227/119; 227/120

[58] Field of Search ..... 227/120, 119, 227/135, 136, 137, 123

[56] References Cited

U.S. PATENT DOCUMENTS

| | | | |
|---|---|---|---|
| 3,330,462 | 7/1967 | Colechia et al. | 227/136 |
| 4,319,705 | 3/1982 | Geist et al. | 227/120 |
| 4,585,154 | 4/1986 | Fealey et al. | 227/120 |
| 4,600,135 | 7/1986 | Mukoyama | 227/120 |
| 4,942,996 | 7/1990 | Wolfberg et al. | 227/136 |
| 5,193,730 | 3/1993 | Tanaka et al. | 227/136 |
| 5,697,541 | 12/1997 | Burke et al. | 227/136 |
| 5,738,266 | 4/1998 | Ogawa | 227/119 |
| 5,799,856 | 9/1998 | Mukoyama | 227/136 |

*Primary Examiner*—Scott A. Smith
*Attorney, Agent, or Firm*—Thomas W. Buckman; Mark W. Croll; John P. O'Brien

[57] ABSTRACT

In a fastener-driving tool comprising a housing structure and a magazine, a structure fixed to the nosepiece is adapted to confine one of two sides of a leading portion of a strip of fasteners so as to guide the leading portion of the strip along fastener-guiding surfaces of the fixed structure. Moreover, a structure hinged to the nosepiece is adapted to be hingedly moved between an operative position and inoperative positions and is adapted when disposed in the operative position to confine the other side of the leading portion of the strip so as to guide the leading portion of the strip along fastener-guiding surfaces of the hinged structure. The hinged structure includes a polymeric cover hinged to the nosepiece, a holding member, and two wear guards, which are spaced one above the other, which are made of metal, and which are mounted so as to define the guiding surfaces of the hinged structure. In one contemplated embodiment, the polymeric cover has two rails spaced one above the other, and each wear guard is slidable on insert molded onto one of the rails. In another contemplated embodiment, the polymeric cover, the holding member, and the wear guards are hinged independently to the nosepiece about a common axis.

10 Claims, 4 Drawing Sheets

FASTENER-DRIVING TOOL HAVING WEAR GUARD DEFINING FASTENER-GUIDING SURFACE

TECHNICAL FIELD OF THE INVENTION

This invention pertains to improvements in a fastener-driving tool of a type illustrated and described in U.S. Pat. No. 4,942,996 to Wolfberg et al., wherein a structure fixed to a nosepiece of the tool and a structure hinged to the nosepiece are adapted to confine a leading portion of a strip of collated fasteners. As improved by this invention, the hinged structure includes a polymeric cover, which is hinged to the nosepiece, and a wear guard, which is made of metal and which is mounted so as to define fastener-guiding surfaces.

BACKGROUND OF THE INVENTION

Typically, a fastener-driving tool of the type noted above comprises a housing structure having a nosepiece defining a drive track, a magazine mounted to the housing structure and adapted to store a strip of collated fasteners so that a leading portion of the strip extends from the magazine toward the drive track, and two other structures, one fixed to the nosepiece and the other hinged to the nosepiece, which are adapted to confine the leading portion of the strip so as to guide the leading portion of the strip along fastener-driving surfaces of the coacting structures.

As known heretofore, the fixed structure is adapted to confine one of two sides of the leading portion of the strip so as to guide the leading portion of the strip along fastener-guiding surfaces of the fixed structure. Moreover, the hinged structure is adapted to be hingedly moved between an operative position and inoperative positions. Furthermore, the hinged structure is adapted when disposed in the operative position to confine the other side of the leading portion of the strip so as to guide the leading portion of the strip along fastener-guiding surfaces of the hinged structure.

As illustrated and described in U.S. Pat. No. 4,942,996 to Wolfberg et al., the hinged structure includes a hinged cover, which is hinged to the nosepiece so as to be hingedly movable between an operative position and inoperative positions. Further, the hinged structure includes a holding member, which is hinged to the nosepiece, which is adapted when in an operative position to hold a fastener, and which is movable to inoperative positions, when the hinged cover is moved to an inoperative position, so as to allow a jammed fastener to be cleared from the tool. As known heretofore, the hinged cover is made of steel, which does not tend to wear excessively. However, it would be highly desirable to mold the hinged cover from a polymeric material, but it would tend to wear excessively.

SUMMARY OF THE INVENTION

This invention provides improvements enabling a polymeric cover to be effectively employed in a fastener-driving tool of the type noted above. Because of this invention, excessive wear of the polymeric cover is not encountered.

Broadly, the fastener-driving tool comprises a housing structure having a nosepiece defining a drive track, a magazine mounted to the housing structure and adapted to store a strip of collated fasteners so that a leading portion of the strip extends from the magazine toward the drive track, and two other structures, one fixed to the nosepiece and the other hinged to the nosepiece, which are adapted to confine the leading portion of the strip so as to guide the leading portion of the strip along fastener-driving surfaces of the coacting structures.

Specifically, the fixed structure is adapted to confine one of two sides of the leading portion of the strip so as to guide the leading portion of the strip along fastener-guiding surfaces of the fixed structure. Moreover, the a hinged structure is adapted to be hingedly moved between an operative position and inoperative positions. Furthermore, the hinged structure is adapted when disposed in the operative position to confine the other side of the leading portion of the strip so as to guide the leading portion of the strip along fastener-guiding surfaces of the hinged structure.

As improved by this invention, the hinged structure includes a polymeric cover, which is hinged to the nosepiece, and a wear guard, which is made of metal and which is mounted so as to define at least one of the guiding surfaces of the hinged structure. Preferably, the hinged structure includes two such guards, which are spaced one above the other.

In one contemplated embodiment, the wear guards are mounted to the polymeric cover so as to be conjointly movable with the cover between the operative and inoperative positions. Preferably, the polymeric cover has a rail for each wear guard, which is slidable onto the rail or which is insert molded into the polymeric cover.

In another contemplated embodiment, in which the wear guards are hinged to the nosepiece, the polymeric cover and the wear guides are hinged so as to be independently movable when the hinged structure is disposed in an inoperative position. Preferably, the polymeric cover and the wear guides are hinged independently to the nosepiece about a common axis.

Moreover, in either contemplated embodiment, the hinged structure may further include a holding member hinged to the nosepiece and arranged to define at least another of the guiding surfaces.

Preferably, in the embodiment noted above wherein a wear guide is slidable onto a rail, the holding member is disposed at one end of the rail, so as to prevent the wear guard from moving past the same end of the rail, in the operative position of the hinged structure.

Preferably, in the other embodiment noted above, the polymeric cover, the holding member, and the wear guard are hinged so as to be independently movable.

These and other objects, features, and advantages of this invention are evident from the following description of two contemplated embodiments of this invention, with reference to the accompanying drawings.

DETAILED DESCRIPTION OF THE ILLUSTRATED EMBODIMENTS

Figure 4:
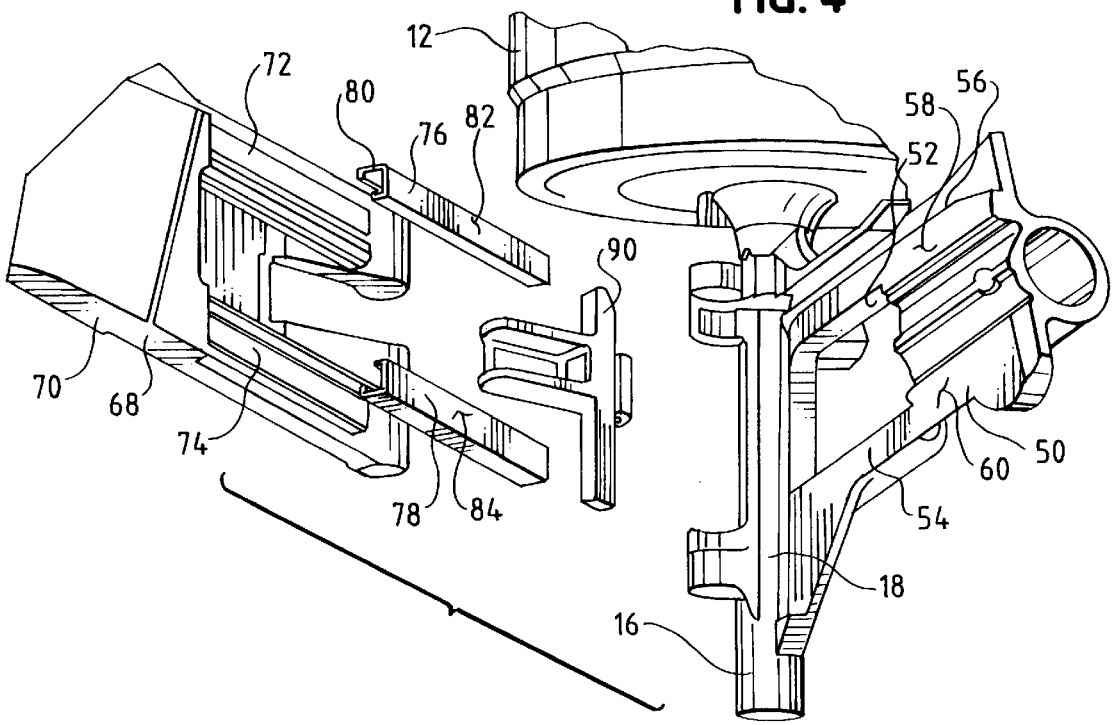
Figure 5:
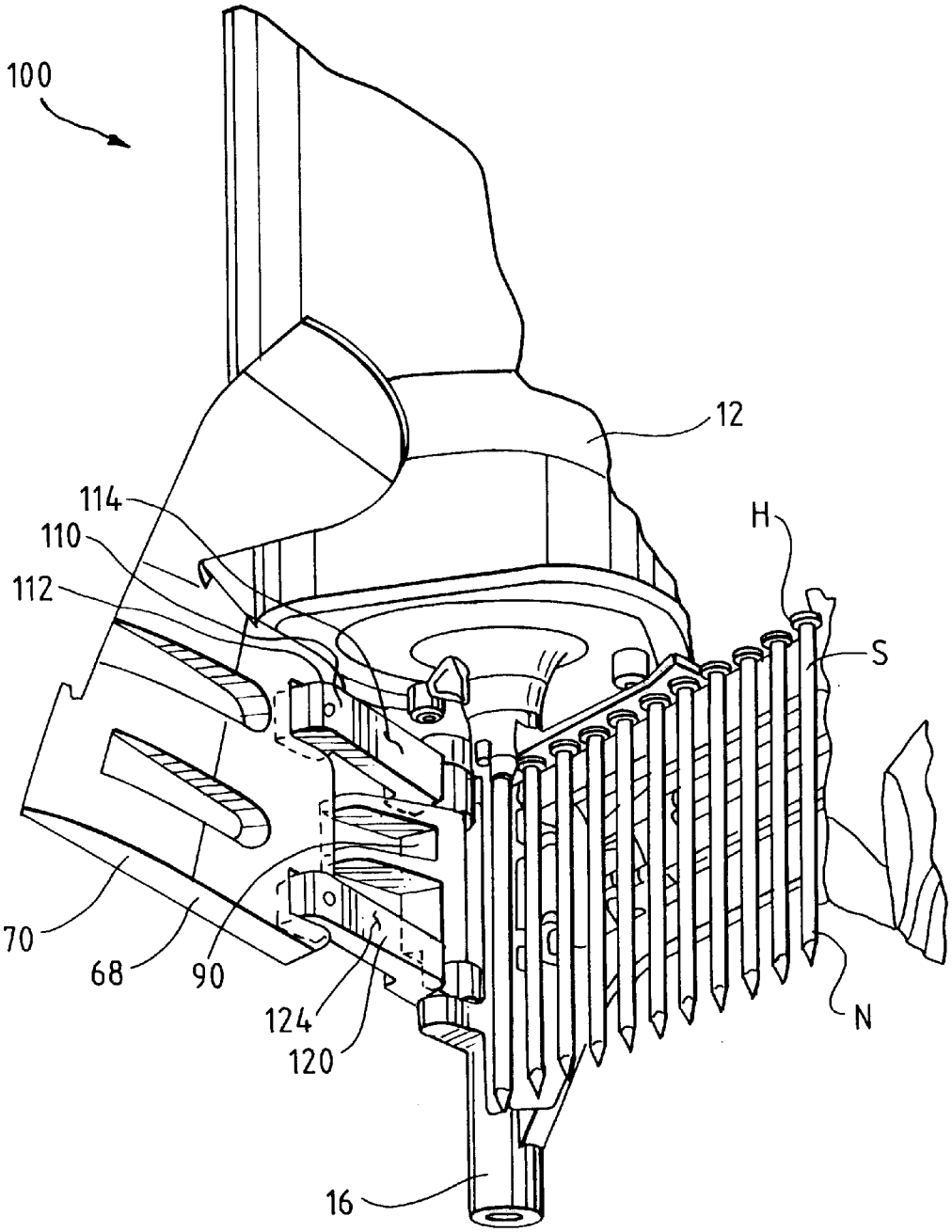
FIGS. 5 and 6, on a similar scale, are fragmentary, perspective views of certain elements of a portable, pneumatically powered, fastener-driving tool according to another contemplated embodiment of this invention. A hinged structure, which includes a polymeric cover, a holding member, and a wear guard, is shown in an inoperative position in FIG. 5 and in an exploded condition in FIG. 6.
Figure 6:
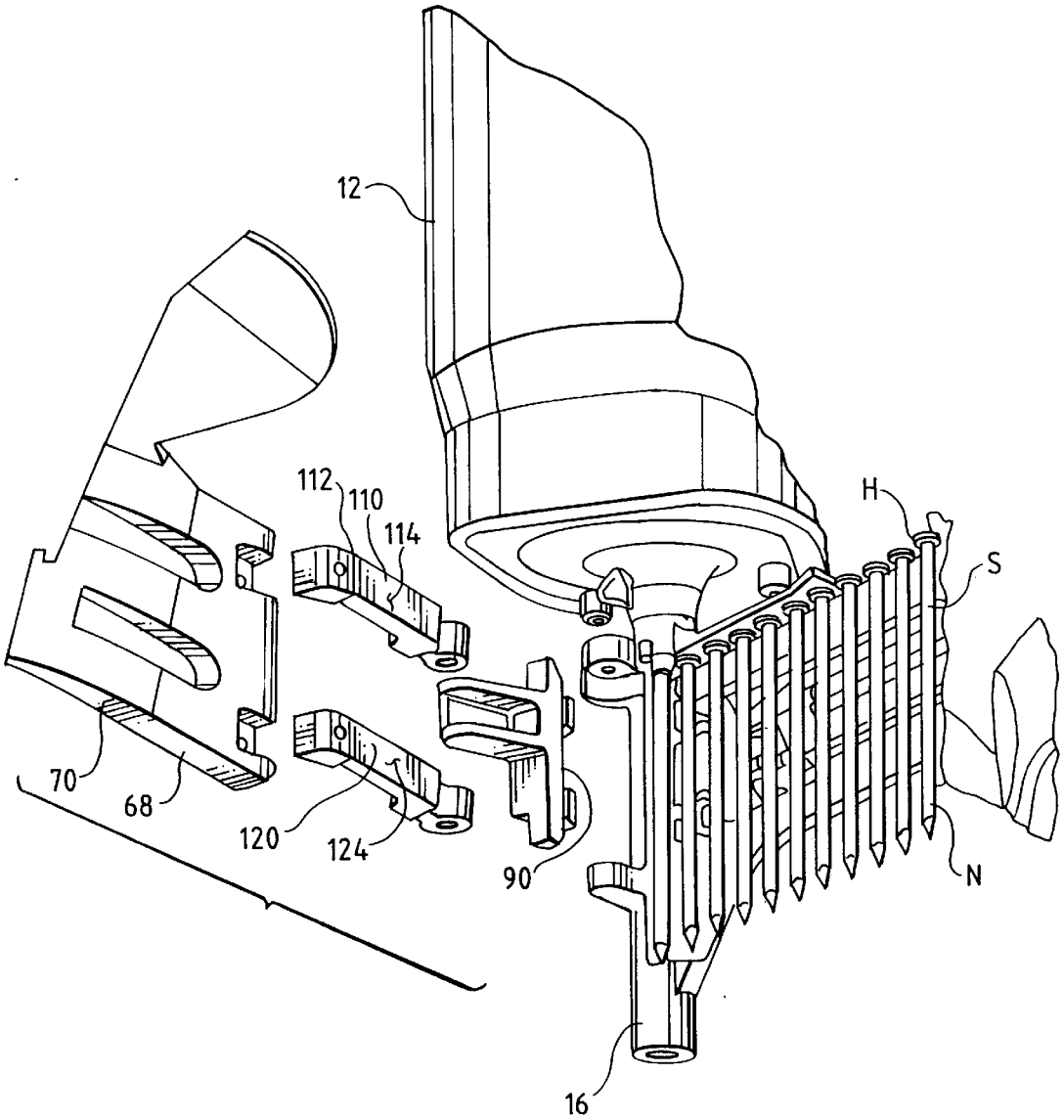

As shown in FIGS. 1 through 4, a portable, pneumatically powered, fastener-driving tool 10 constitutes one contemplated embodiment of this invention. As shown in FIGS. 5 and 6, a portable, pneumatically powered, fastener-driving tool 100 constitutes another contemplated embodiment of this invention. As shown, each contemplated tool 10, 100, is a nail-driving tool.

Except as illustrated and described herein, the fastener-driving tools 10, 100, may be structurally and functionally similar to the fastener-driving tool disclosed in U.S. Pat. No. 4,942,996, supra, the disclosure of which is incorporated herein by reference, and may be structurally and functionally similar to portable, pneumatically powered, fastener-driving tools manufactured and sold by ITW Paslode (a unit of Illinois Tool Works Inc.) of Vernon Hills, Ill. As compared to the fastener-driving tool disclosed therein, each of the fastener-driving tools 10, 100, embodies improvements described below and enabling a polymeric cover to be effectively employed without excessive wear of the polymeric cover.

Broadly, the fastener-driving tool 10 comprises a housing structure 12 including a handle 14 and including a nosepiece 16, which is mounted to the housing structure 12 and which defines a drive track 18. The drive track 18 is adapted to receive a nail N and to guide the nail N as the nail N is driven from the drive track 18 into a workpiece (not shown) of wood or other material. As disclosed in U.S. Pat. No. 4,942,996, supra, a driver (not shown) operated by a piston and cylinder mechanism (not shown) is arranged to be explosively driven by compressed air so as to drive a nail from the drive track 18 when the fastener-driving tool 10 is actuated.

Moreover, the fastener-driving tool 10 comprises a magazine 30, which is mounted to the housing structure 12 in spaced relation to the drive track 18. The magazine 30 is adapted to store a strip of collated nails N so that a leading portion of the strip extends from the magazine 30 toward the drive track 18. As disclosed in U.S. Pat. No. 4,942,996, supra, a nail-feeding mechanism 40 is provided for feeding the nails N individually and sequentially from the strip of collated nails N into the drive track 18.

The nail-feeding mechanism 40 includes a fixed structure 50, which may be structurally and functionally similar to the fixed structure of the nail-feeding mechanism disclosed therein, and a hinged structure 68, which differs from the hinged structure of the nail-feeding mechanism disclosed therein. Other elements of the nail-feeding mechanism 40 are similar to known elements exemplified in U.S. Pat. No. 4,942,996, supra, and are not shown.

Figure 1:
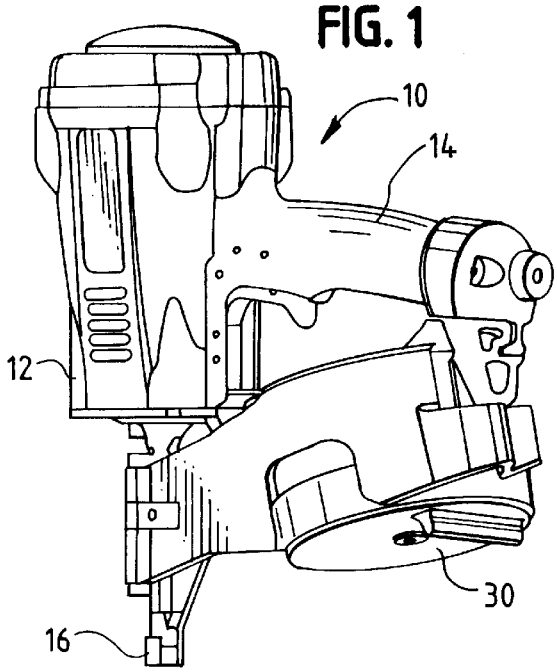
FIG. 1 is a perspective view of a portable, pneumatically powered, fastener-driving tool according to one contemplated embodiment of this invention.
Figure 2A:
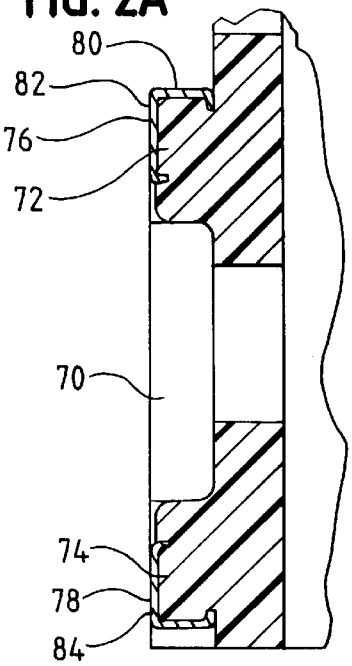
FIG. 2A is a fragmentary, sectional view taken along line 2A—2A in FIG. 2, in a direction indicated by arrows.
Figure 2:
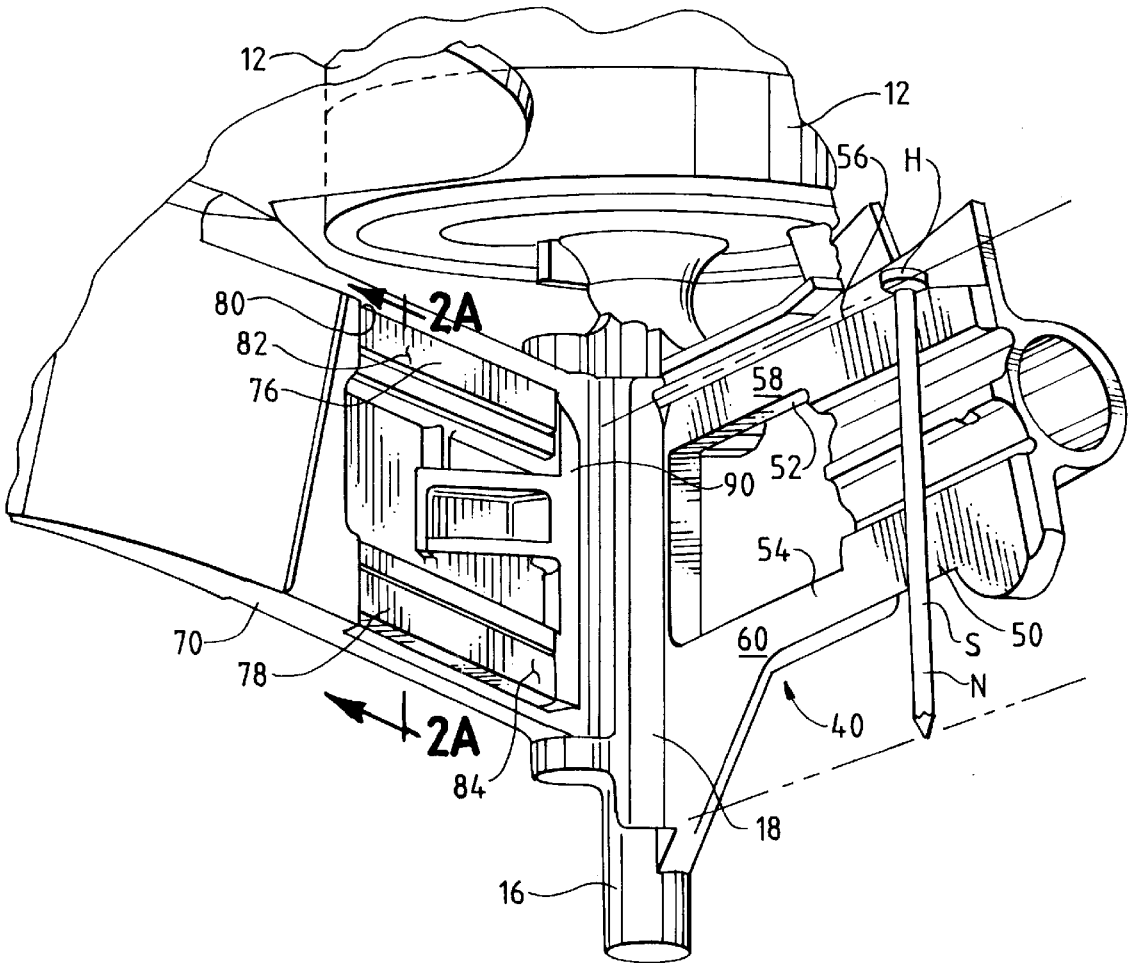
FIGS. 2, 3, and 4, on a larger scale, are fragmentary, perspective views of certain elements of the fastener-driving tool according to the embodiment of FIG. 1. A hinged structure including a polymeric cover mounting two wear guards and including a holding member is shown in an inoperative position in FIG. 2, in an operative position in FIG. 3, and in an exploded condition in FIG. 4.
Figure 3:
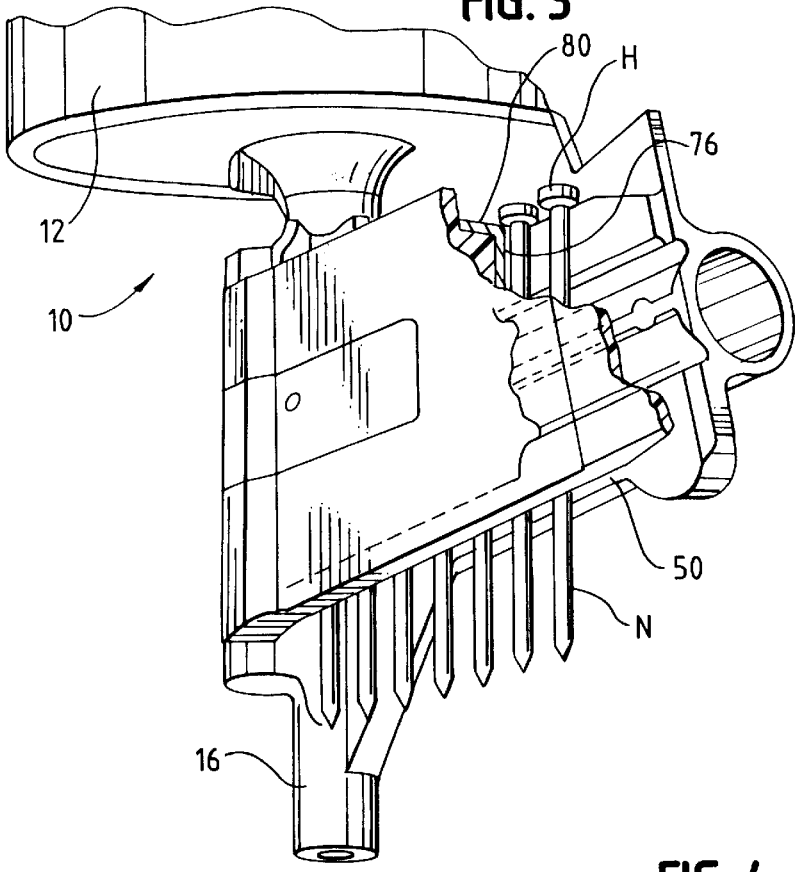

The fixed structure 50, which may be entirely made of steel, is fixed to or unitary with the nosepiece 16 and is adapted to confine one of two sides of the leading portion of the strip of collated nails N, the far side in FIGS. 1 through 4, so as to guide the leading portion thereof along fastener-guiding surfaces defined by an upper, elongate portion 52 of the fixed structure 50 and by a lower, elongate portion 54 of the fixed structure 50. As shown in FIG. 2, the heads H of the nails N are guided along an upper guiding surface 56 of the upper elongate portion 52, while the shanks S of the nails N are guided along coplanar guiding surfaces 58, 60, of the respective portions 52, 54. Because the respective portions 52, 54 are made of steel, these guiding surfaces 56, 58, 60, do not tend to wear excessively.

The hinged structure 68, which is hinged to the nosepiece 16, is adapted to be hingedly moved between an operative position and inoperative positions and is adapted when disposed in the operative position to confine the other side of the leading portion of the strip of collated nails N, the near side in FIGS. 1 through 4, so as to guide the leading portion thereof along fastener-guiding surfaces defined by certain elements of the hinged structure 68 and described below. Broadly, therefore, the hinged structure 68 is similar to the hinged structure disclosed in U.S. Pat. No. 4,942,996, supra.

As compared to the hinged structure disclosed therein, the hinged structure 68 includes a polymeric cover 70, which is lighter and less expensive than a steel cover and which is easier to manufacture. As shown in FIG. 4, the polymeric cover 70 is molded so as to have an upper rail 72 and a lower rail 74. Moreover, the hinged structure 68 includes an upper wear guard 76, which is made of steel and which is insert molded onto the upper rail 72, and a lower wear guard 78, which is made of steel and which is insert molded onto the lower rail 74. Alternatively, the wear guards 76, 78, are slidable onto the respective rails 72, 74.

The upper wear guard 76 defines an upper guiding surface 80, along which the heads H of the nails N of the strip are guided, and the respective wear guards 76, 78, define coplanar guiding surfaces 82, 84, along which the shanks S of the nails N of the strip are guided. Because the respective wear guards 76, 78, are made of steel, these guiding surfaces 80, 82, 84, do not tend to wear excessively. However, if the polymeric cover 70 were to define guiding surfaces without wear guards, those surfaces would tend to wear excessively.

Furthermore, the hinged structures 70 further includes a holding member 90, which may be structurally and functionally similar to the holding member disclosed in U.S. Pat. No. 4,942,996, supra. The polymeric cover 70 and the holding member 90 are hinged to the nosepiece 16 via a hinge pin (not shown) so as to be independently movable when the hinged structure 68 is disposed in an inoperative position. Besides its functions disclosed in U.S. Pat. No. 4,942,996, supra, the holding member 90 serves a further function by being disposed against one end of each rail 72, 74, the end nearer to the nosepiece 16, so as to prevent the wear guard 76, 78, on such rail 72, 74, from moving past the same end such as rail 72, 74, in the operative position of the hinged structure 68.

The embodiment shown in FIGS. 5 and 6 is similar to the embodiment shown in FIGS. 1 through 4, except that the rails 72, 74, and the wear guards 76, 78, are omitted, whereas the hinged structure 68 of the fastener-driving tool 100 includes an upper wear guard 110 and an identical lower wear guard 120. Each wear guard 110, 120, is made of steel and is hinged to the nosepiece via the hinge pin (not shown) hinging the polymeric cover 70 and the holding member 90 to the nosepiece 16 so as to be independently movable when the hinged structure 68 is disposed in an inoperative position. The upper wear guard 110 defines an upper guiding surface 112, along which the heads H of the nails N of the strip are guided, and the respective wear guards 110, 120, define coplanar guiding surfaces 114, 124, along which the shanks S of the nails N of the strip are guided.

Various modifications may be made in either embodiment described above without departing from the scope and spirit of this invention.

I claim:

1. A fastener-driving tool comprising:

(a) a housing structure having a nosepiece defining a drive track adapted to receive a fastener and to guide the fastener as the fastener is driven from the drive track;

(b) a magazine mounted to the housing structure and adapted to store a strip of collated fasteners so that a leading portion of the strip extends from the magazine toward the drive track;

(c) a fixed structure fixed to the nosepiece and adapted to confine one of two sides of the leading portion of the strip so as to guide the leading portion of the strip along fastener-guiding surfaces of the fixed structure;

(d) a hinged structure hinged to the nosepiece, adapted to be hingedly moved between an operative position and inoperative positions, and adapted when disposed in the operative position to confine the other side of the leading portion of the strip so as to guide the leading portion of the strip along fastener-guiding surfaces of the hinged structure, the hinged structure including a polymeric cover, which is hinged to the nosepiece, and the hinged structure further including a wear guard, which is made of metal and which is mounted so as to define at least one of the fastener-guiding surfaces of the hinged structure.

2. The fastener-driving tool of claim 1 wherein the wear guard is mounted to the polymeric cover so as to be conjointly movable with the cover between the operative and inoperative positions.

3. The fastener-driving tool of claim 2 wherein the polymeric cover has a rail and wherein the wear guard is insert molded onto the rail.

4. The fastener-driving tool of claim 3 wherein the hinged structure further includes a holding member hinged to the nosepiece and arranged to define at least another of the guiding surfaces of the hinged structure, wherein the polymeric cover and the holding member are hinged so as to be independently movable when the hinged structure is disposed in an inoperative position, and wherein the holding member is disposed at one end of the rail, so as to prevent the wear guard from moving past the same end of the rail, in the operative position of the hinged structure.

5. The fastener-driving tool of claim 2 wherein the wear guard is insert molded into the polymeric cover.

6. The fastener-driving tool of claim 5 wherein the hinged structure further includes a holding member hinged to the nosepiece and arranged to define at least another of the guiding surfaces of the hinged structure, wherein the polymeric cover and the holding member are hinged so as to be independently movable when the hinged structure is disposed in an inoperative position, and wherein the holding member is disposed at one end of the rail, so as to prevent the wear guard from moving past the same end of the rail, in the operative position of the hinged structure.

7. The fastener-driving tool of claim 1, 2, 3, 4, 5, or 6, wherein the wear guard is one of two wear guards mounted similarly to the polymeric cover.

8. The fastener-driving tool of claim 1 wherein the wear guard is hinged to the nosepiece and wherein the polymeric cover and the wear guide are hinged so as to be independently movable.

9. The fastener-driving tool of claim 8 wherein the hinged structure further includes a holding member hinged to the nosepiece and arranged to define at least another of the guiding surfaces of the hinged structure, and wherein the polymeric cover, the holding member, and the wear guide are hinged so as to be independently movable when the hinged structure is disposed in an inoperative position.

10. The fastener-driving tool of claim 8 or 9 wherein the wear guard is one of two wear guards hinged similarly to the nosepiece.

* * * * *